US006782899B2

(12) United States Patent
Kim et al.

(10) Patent No.: US 6,782,899 B2
(45) Date of Patent: Aug. 31, 2004

(54) DISHWASHER

(75) Inventors: Kyeong Hwan Kim, Puchun-si (KR); Si Moon Jeon, Seoul (KR); Tae Hee Lee, Seoul (KR); Dae Yeong Han, Seoul (KR)

(73) Assignee: LG Electronics Inc., Seoul (KR)

( * ) Notice: Subject to any disclaimer, the term of this patent is extended or adjusted under 35 U.S.C. 154(b) by 250 days.

(21) Appl. No.: 09/955,153

(22) Filed: Sep. 19, 2001

(65) Prior Publication Data

US 2002/0074026 A1 Jun. 20, 2002

(30) Foreign Application Priority Data

Dec. 14, 2000 (KR) ..... 2000-0076511
Apr. 20, 2001 (KR) ..... 2001-0021441

(51) Int. Cl.[7] ..... B08B 3/02

(52) U.S. Cl. ..... 134/104.1; 134/104.4; 134/111

(58) Field of Search ..... 134/104.1, 104.4, 134/111, 560, 570

(56) References Cited

U.S. PATENT DOCUMENTS 3,491,780 A * 1/1970 Kaldenberg
3,542,594 A * 11/1970 Smith et al.
3,989,054 A * 11/1976 Mercer
4,038,103 A * 7/1977 Grunewald
4,673,441 A * 6/1987 Mayers
4,972,861 A * 11/1990 Milocco et al.
4,998,548 A * 3/1991 Lagerstrand
5,097,855 A * 3/1992 Martinsson et al.
5,429,679 A * 7/1995 Young et al.
5,601,660 A * 2/1997 Jeon et al.
5,609,172 A * 3/1997 Chang et al.
5,711,325 A * 1/1998 Kloss et al.
5,730,805 A * 3/1998 Bertsch et al.
5,849,101 A * 12/1998 Edwards
5,937,879 A * 8/1999 Payzant
6,454,872 B1 * 9/2002 Miller et al.

FOREIGN PATENT DOCUMENTS

KR 1995-02705 2/1995
KR 20000176946 B1 11/1998

* cited by examiner

*Primary Examiner*—Frankie L. Stinson
(74) *Attorney, Agent, or Firm*—Fleshner & Kim, LLP

(57) ABSTRACT

A dishwasher is provided which uses a combined circulation/drain pump and an improved filtering system to enhance cleaning capability. The circulation section of the pump provides pressurization and supplies wash water to a spray arm of the dishwasher, while the drain section discharges the wash water. This single pump reduces space requirements, as well as manufacturing costs. A two stage filtration system may be used in the water collection area of the dishwasher to filter out unwanted material, and a third filter may further filter wash water prior to recirculation. Self cleansing mechanisms associated with each of the filters may be used to keep the filters free from obstructions and allow for the unobstructed flow and discharge of wash water.

32 Claims, 10 Drawing Sheets

DISHWASHER

BACKGROUND OF THE INVENTION

1. Field of the Invention

The present invention relates to a dishwasher, and more particularly, to a dishwasher having a simple structure and an improved function of filtering washing water.

2. Description of the Prior Art

A dishwasher is an appliance for automatically washing the dishes by spraying detergent-mixed washing water. The dishwasher having a variety of structures and shapes has been proposed. Hereinafter, the constitution of such conventional dishwasher will be briefly explained.

FIG. 1 is a view illustrating the constitution of the conventional dishwasher.

Referring to FIG. 1, the conventional dishwasher includes a case 10, a rack 20 installed in the case 10 for accommodating the dishes, a spray arm 30 installed below the rack 20, a circulation pump 40 for pressurizing and supplying washing water to the spray arm 30, a drain pump 50 for draining the washing water, a filtering means for filtering the washing water, and the like.

Further, the spray arm 30 is horizontally rotatably supported by an arm holder 32 and is provided thereon with a plurality of spray nozzles 301 facing the rack 20. Furthermore, the circulation pump 40 is constructed such that a discharge port thereof is connected to the arm holder 32 and an inlet port thereof is connected to a water collector 60 for constructing the filtering means.

The filtering means includes the water collector 60 disposed below a bottom surface of a case 10, and a primary filter (coarse filter) 62 and a secondary filter (fine filter) 64 which are installed in the water collector 60. A top face of the water collector 60 is opened toward a so-called washing space, a side face thereof is connected to the circulation pump 40, and a bottom face thereof is connected to the drain pump 50. The secondary filter 64 is constructed in the form of a pipe such that a lower part thereof can communicate with the drain pump 50, and the primary filter 62 is constructed in the form of a filtering net provided within the secondary filter 64.

The operation of the conventional dishwasher as described above can be broadly divided into a washing step and a drain step, and can be performed according to these steps. In the washing step, washing water in which pure water and detergent are mixed together is pressurized and supplied to the spray arm 30 by the circulation pump 40. The washing water is then sprayed, through the spraying nozzles 301, on the dishes d seated on the rack 20. Consequently, the operation of washing the dishes d can be performed. Furthermore, in the drain step, the washing water can be discharged by the operation of the drain pump 50.

FIG. 2 is a view illustrating a filtering process of the conventional dishwasher.

Referring to FIGS. 1 and 2, the washing and drain operations thereof will be explained in detail. As shown in FIG. 2, the washing water sprayed from the spray arm 30 is subject to a circulation operation that it is collected into the water collector 60 disposed on a lower portion of the case and then supplied again to the spray arm 30 by the circulation pump 40. While the washing water is circulated, garbage such as food particles separated from the dishes d is filtered out or strained out by the primary and secondary filters 62, 64 installed in the water collector 60, and thus, the washing water can be prevented from being dirty. Furthermore, at this time, the drain pump 50 should be not operating to prevent the washing water from draining.

The drain step progresses after the washing step for a predetermined period of time has been completed. In the drain step, the washing water is discharged by the operation of the drain pump 50. At this time, a part of garbage particles that are large are filtered out by the primary filter 62 preventing a drain port from clogging. The filtered food particles remain in the primary filter 62. Further, garbage, of which particles are small and has not been filtered by the primary filter 62 are filtered by the secondary filter 64, and discharged together with the washing water through the drain port of the drain pump 50.

While washing the dishes, a round of the washing/drain step can be performed by only a so-called single filling-up of the water. In general, during one round of washing the dishes, three or four times of filling-up of the water and subsequent washing/drain steps can be performed in order to enhance efficiency of washing the dishes.

However, the conventional dishwasher described above has required both the circulation pump 40 for use in the washing and rinsing processes and the drain pump 50 for use in the draining process. Therefore, there are problems in that the structure thereof is complex and the production costs thereof are high.

Further, according to the conventional dishwasher, the garbage adheres to the secondary filter 64 from the viewpoint of the structural nature of the secondary filter 64 (i.e., fine filter has fine meshes), and the garbage adhered thereto is not smoothly discharged during the drain step. Thus, newly supplied washing water may be contaminated. Accordingly, there are problems in that washing efficiency is reduced and the garbage adhered to the secondary filter deteriorates circulation efficiency of the newly supplied washing water.

Furthermore, after the washing process has been finally completed, the garbage filtered out by the respective filters 62, 64 should be removed. However, the garbage filtered out by the primary filter 62 is easily removed since the particles thereof are relatively large, whereas the fine garbage caught in the secondary filter 64 is not easily removed. Therefore, the problem that convenience of use is lowered is produced.

SUMMARY OF THE INVENTION

The present invention is contemplated to solve the above problems in the prior art. The present invention newly proposes a flow passage, a pump and a filtering structure of a dishwasher. To this end, the dishwasher of the present invention comprises a case; a rack installed in the case for accommodating the dishes; a spray arm installed below the rack for spraying washing water; a combined circulation/drain pump including an upper pump for repeatedly pressurizing and supplying the washing water to the spray arm and a lower pump for discharging the washing water; and a filtering means for filtering the washing water, which includes a water collector formed below a bottom surface of the case and in a washing water flow passage connected to the combined circulation/drain pump, a filter provided in the water collector for filtering out garbage, a filter self-cleansing means for performing self-cleansing operation of the filter, a garbage collecting chamber that is provided below the bottom surface of the case and is connected to both a washing water discharge port of the upper pump and a drain flow passage of the lower pump, a fine filter mounted on a top surface of the garbage collecting chamber for filtering out the garbage from the washing water discharged upward, and a fine filter self-cleansing means for performing self-cleansing operation of the fine filter.

According to the dishwasher of the present invention, there is an advantage in that a user can more conveniently utilize the dishwasher, since the filtering means having the self-cleansing means installed therein is employed in the dishwasher.

DETAILED DESCRIPTION OF THE INVENTION

Hereinafter, embodiments of the present invention will be described in detail with reference to FIGS. 3 to 9 of the accompanying drawings.

A dishwasher according to an embodiment of the present invention includes a combined circulation/drain pump 70 for pressurizing and supplying washing water to a spray arm 30 and for draining the washing water; and a filtering means for filtering the washing water.

Figure 1:
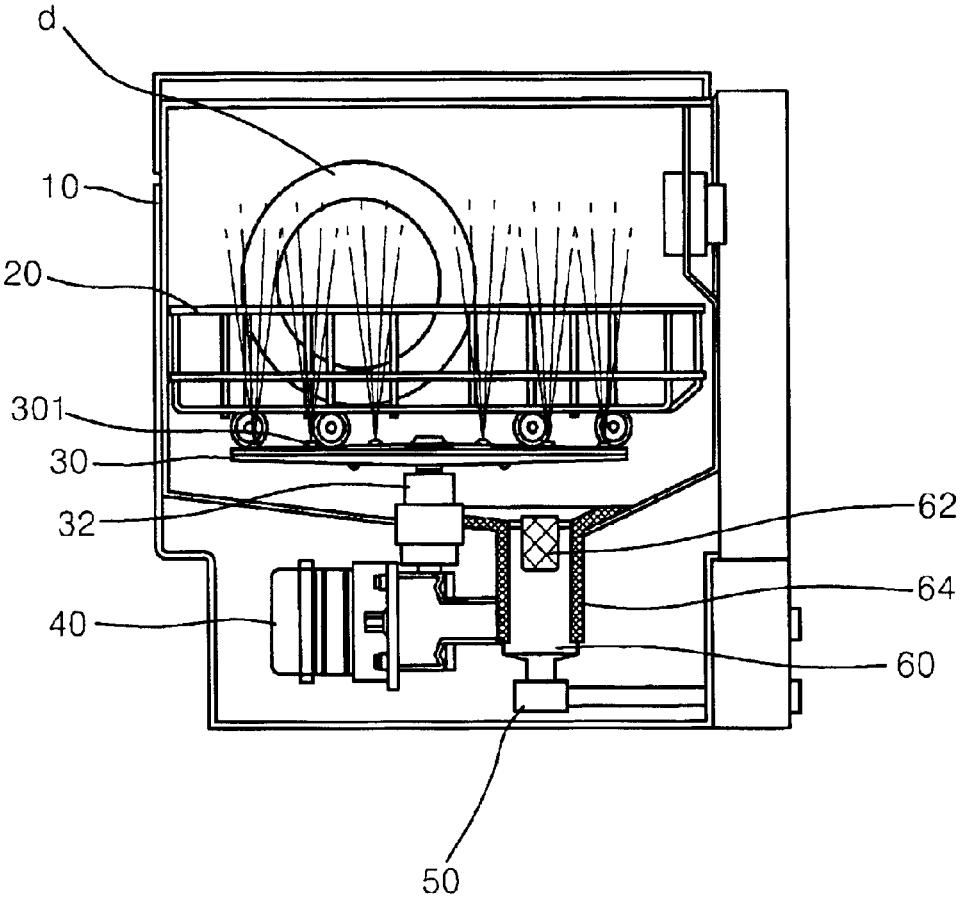
FIG. 1 is a view illustrating the constitution of a conventional dishwasher.
Figure 2:
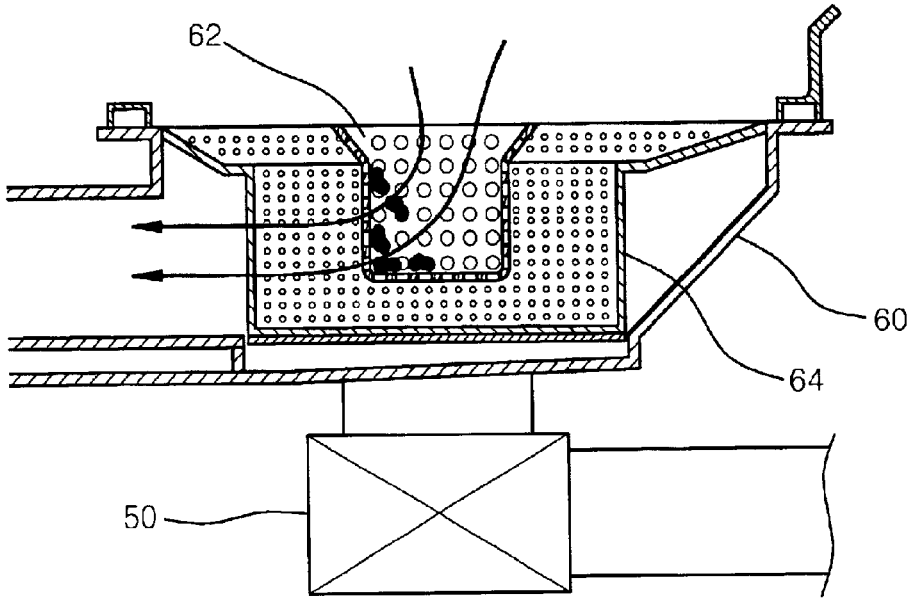
FIG. 2 is a view illustrating a filtering process of the conventional dishwasher.
Figure 3:
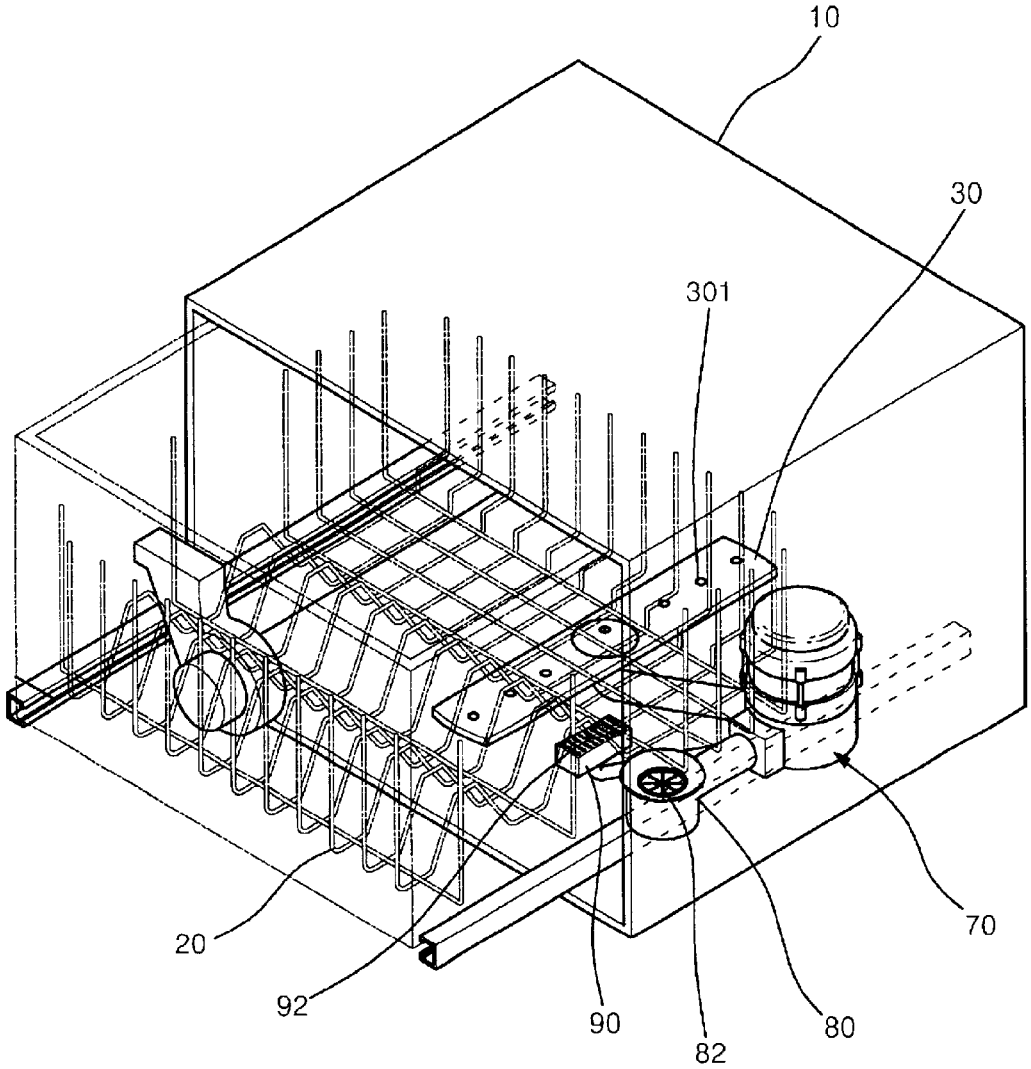
FIG. 3 is a perspective view of a dishwasher according to an embodiment of the present invention.
Figure 4:
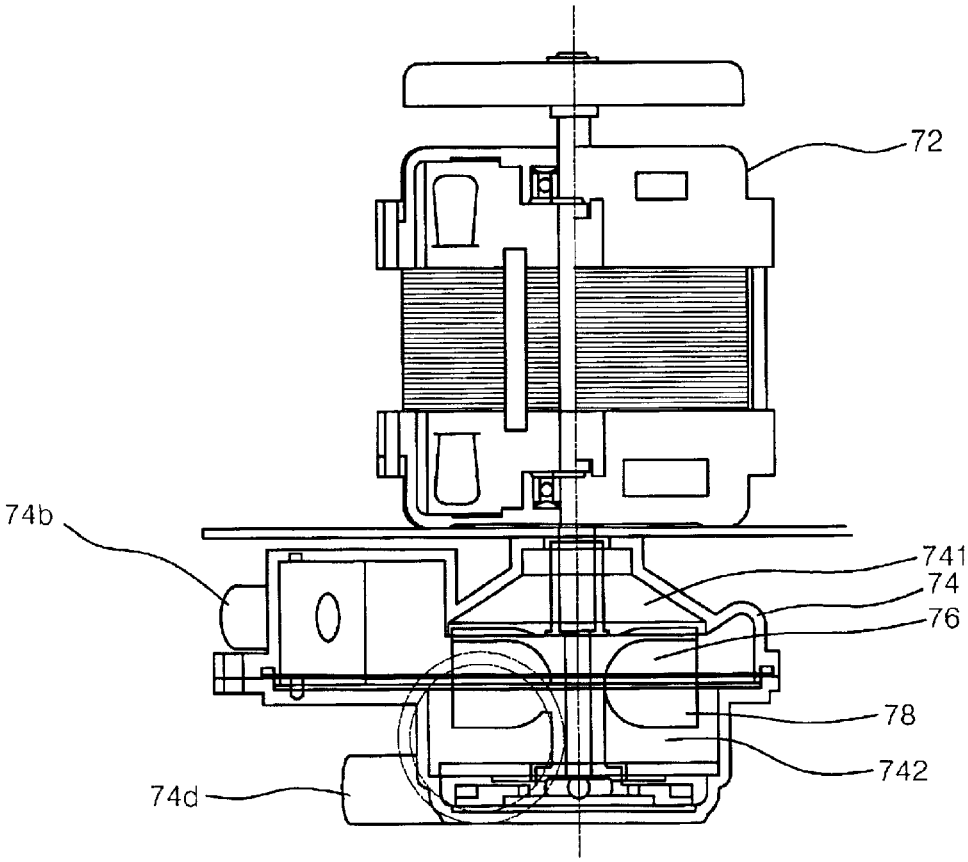
FIG. 4 is a vertical sectional view of a combined circulation/drain pump employed in the dishwasher according to the embodiment of the present invention.

As shown in FIG. 4, the combined circulation/drain pump 70 includes a driving motor 72; a pump casing 74 of which inner space is divided into a circulating section 741 and a drain section 742; and upper and lower pumps 76, 78 disposed in the circulating section 741 and the drain section 742 of the pump casing 74, respectively, and connected to a rotating shaft of the driving motor 72 so as to make a flow of the washing water. In particular, it is preferable that a centrifugal pump should be used for the upper pump 76 and a friction pump be used for the lower pump 78.

Here, the upper and lower pumps 76, 78 are in charge of the supply and drain of water, respectively. The circulating section 741 of the pump casing 74 is formed with a washing water inlet port 74*a* and a washing water discharge port 74*b,* and the drain section 742 is formed with a drain inlet port 74*c* and a drain discharge port 74*d* (see FIG. 5*a*).

Further, the filtering means includes a water collector 80 provided below a bottom surface of a case 10 and located in a washing water flow passage drawn into the combined circulation/drain pump 70; a primary filter 82 and a secondary filter 81 (see FIG. 10*a*) provided in the water collector 80; a garbage collecting chamber 90 provided below the bottom surface of the case 10; a fine filter 92 mounted on a top surface of the garbage collecting chamber 90; and a fine filter self-cleansing means for performing a self-cleansing operation of the fine filter 92. Moreover, the primary and secondary filters 82, 81 may also be provided with a self-cleansing means, which will be described later.

The primary filter 82 is a coarse filter formed in a shape of a basket similar to a conventional filter and filters a part of garbage having relatively large particles. The fine filter 92 is a plate-shaped filter having meshes finer than those of the primary filter 82 and strains out garbage having relatively small particles.

Furthermore, the fine filter self-cleansing means includes an auxiliary nozzle 302 (see FIG. 7) provided on a bottom surface of the spray arm 30 so that garbage adhered to the fine filter 92 is separated therefrom by spraying the washing water downward. The auxiliary nozzle 302 is spaced apart at a predetermined distance from the center of rotation of the spray arm 30 so that they pass over the fine filter 92 upon rotation of the spray arm.

The operation of the dishwasher according to the embodiment of the present invention as described above will be explained below.

First, in a washing process, the washing water in which pure water and detergent are mixed is fed by the combined circulation/drain pump 70 to the spray arm 30 through the washing water discharge port 74*b* and is then sprayed from the spray nozzles 301 to the dishes d seated on a rack 20. Thus, an operation of washing the dishes d is made.

Figure 5A:
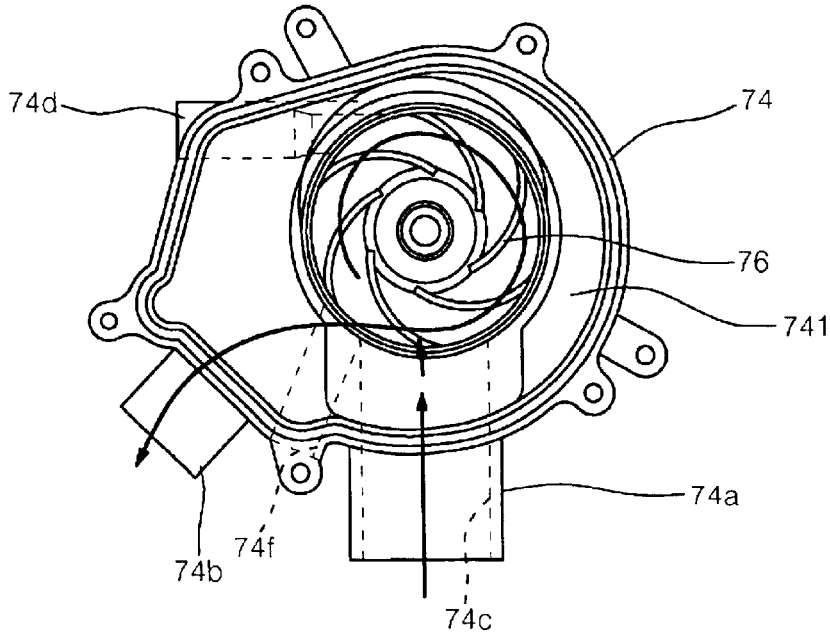
FIGS. 5*a,* 5*b* and 5*c* are views illustrating operations of the combined circulation/drain pump employed in the dishwasher according to the embodiment of the present invention.

That is, as shown in FIG. 5*a,* the upper pump 76 connected to the washing water flow passage rotates in a clockwise direction so that the washing water (designated by a bold arrow in the figure) can flow through the washing water inlet port 74*a* into the circulating section 741 of the pump casing 74. Then, the drawn washing water is pressurized and discharged toward the spray arm 30 by the upper pump 76.

Figure 5B:
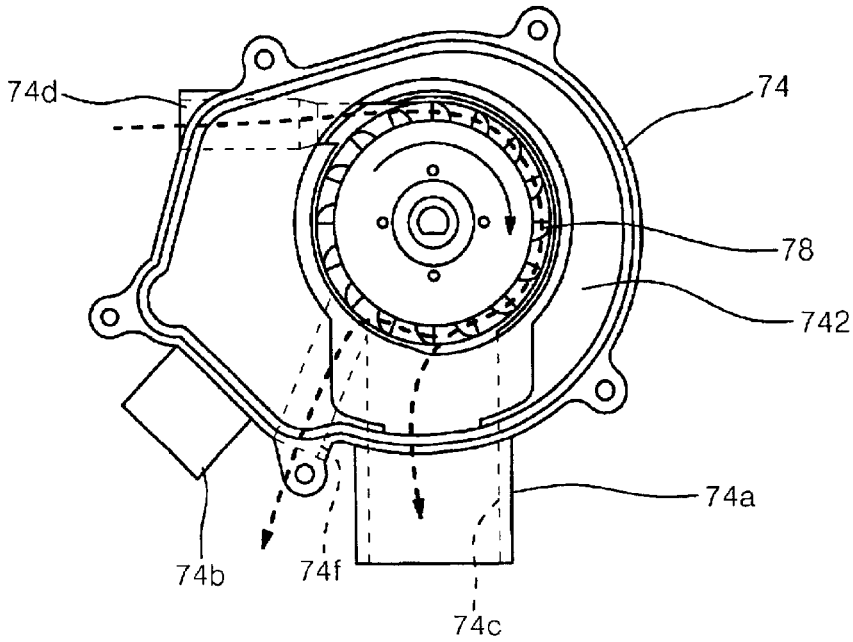

At this time, as shown in FIG. 5*b,* the lower pump 78 rotates in the same direction as the upper pump 76 so that it applies suction force to the drain discharge port 74*d* and discharging force to the drain inlet port 74*c*. Therefore, an operation of introducing the washing water into the drain section 742 through the drain inlet port 74*c* is not made.

Figure 5C:
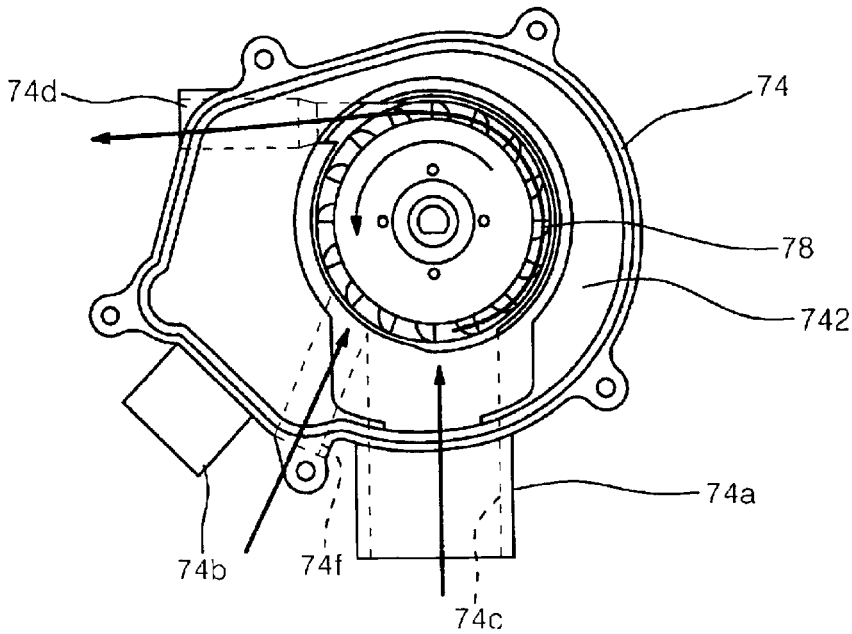

In addition, in a drain process to be performed after completion of the washing process, since the combined circulation/drain pump 70 rotates in a direction opposite to that of the pump 70 in the washing process, i.e. counterclockwise direction, the lower pump 78 also rotates in the counterclockwise direction, as shown in FIG. 5*c*. Therefore, suction force is applied to the drain inlet port 74*c* and discharging force is applied to the drain discharge port 74*d*, so that the washing water is drained through the drain section 742 and discharging force from the upper pump 76 is applied to the washing-water inlet port 74*a* of the circulating section 741. Thus, an operation of circulating the washing water is not made.

In the washing and drain processes, an operation of filtering the washing water is also made by the filtering means. The operation of filtering the washing water is divided into a main filtering operation by means of the primary and secondary filters 82, 81 and an auxiliary filtering operation by means of the fine filter 92.

The main filtering operation by means of the primary and secondary filters 82, 81 is made in such a manner that while the washing water sprayed from the spray arm 30 is circulated once, all the washing water passes through both the primary and secondary filters 82, 81 and garbage mixed with the washing water is then strained out.

Figure 6:
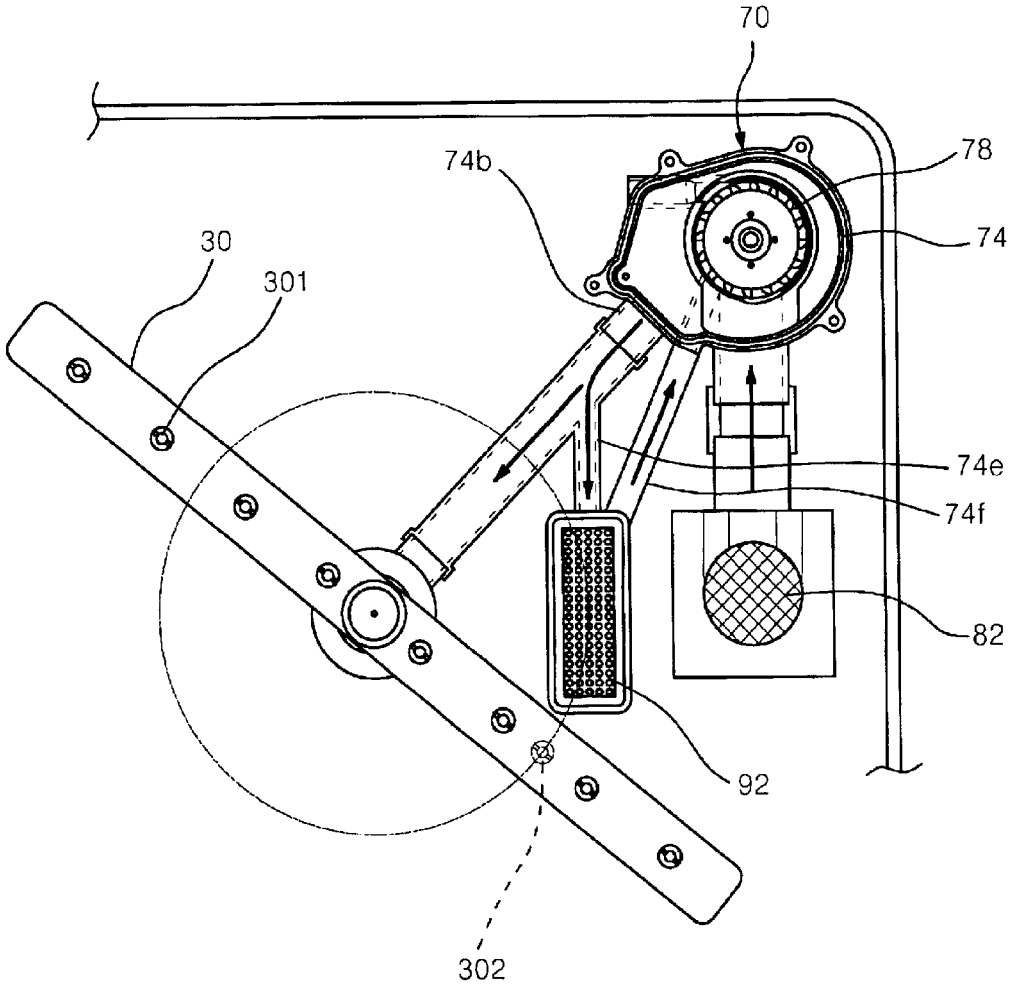
FIG. 6 is a view illustrating a washing water circulation flow path of the dishwasher of the present invention.

The auxiliary filtering operation by means of the fine filter 92 is made in such a manner that a portion of the washing water discharged from the combined circulation/drain pump 70 flows through a branched flow passage 74*e* into the garbage collecting chamber 90 below the fine filter 92 before it flows into the spray arm 30, as shown in FIG. 6, and is then spouted upward from the fine filter 92 (see FIG. 7) so that garbage having fine particles, which has not been filtered out by the primary filter 82, can be strained out by the fine filter 92.

In a case where the circulation of the washing water is repeated predetermined times in the washing process, since there is the same effect that the total amount of washing water that has been fed once has passed through the fine filter 92, garbage having fine particles contained in the washing water is completely strained out.

Figure 7A:
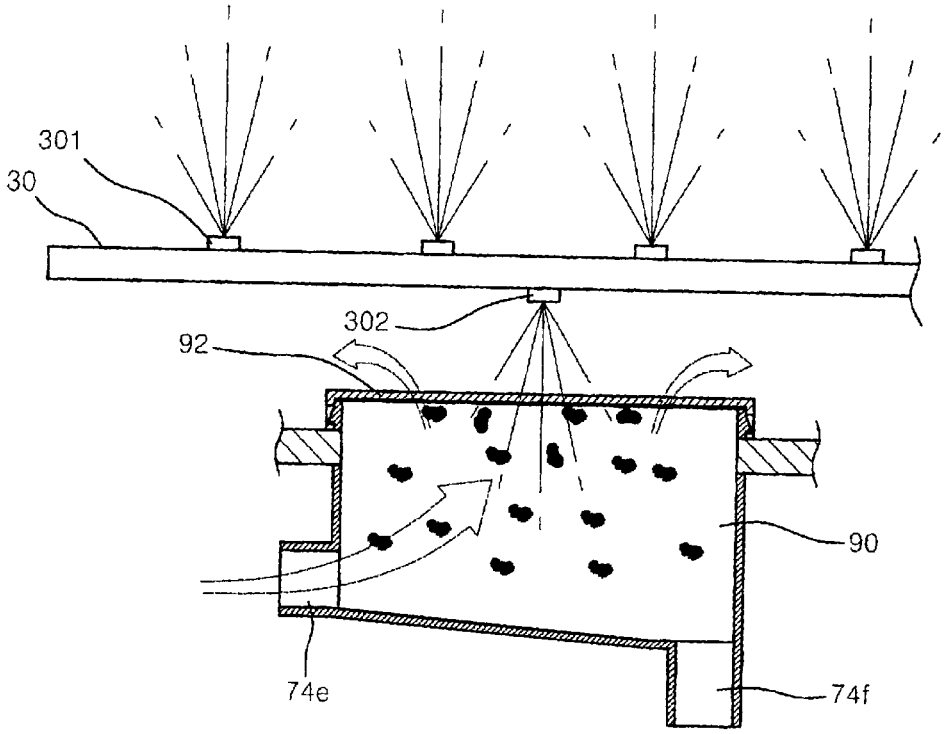
FIGS. 7*a* and 7*b* are views illustrating operations of a fine filter employed in the dishwasher according to the embodiment of the present invention.

On the other hand, in the washing process, the spray arm 30 sprays the washing water through a plurality of spray nozzles 301 directed upward in order to clean the dishes. As shown in FIG. 7*a*, the spray arm 30 is formed with the auxiliary nozzle 302 that spray the washing water downward. The downward sprayed washing water intermittently strikes the top surface of the fine filter 92 so that foreign materials adhered to a bottom surface of the fine filter 92 are removed. That is, the so-called self-cleansing function is performed.

Thus, the garbage trapped in the garbage collecting chamber 90 is maintained in a floating state therein by means of the aforementioned self-cleansing function, so that the fine filter 92 is prevented from being partially clogged with the garbage adhered thereto.

Figure 7B:
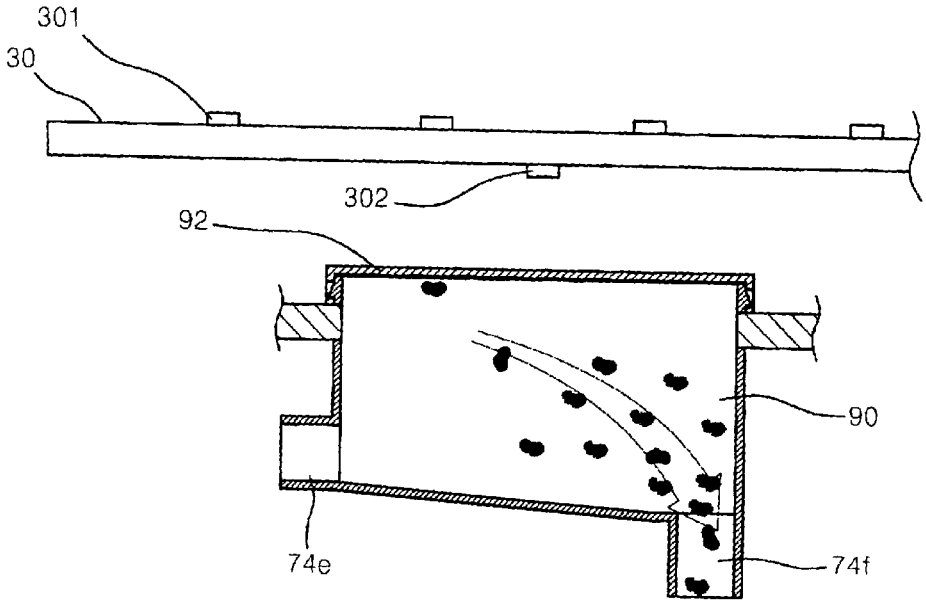

Referring to FIG. 7*b*, when a drain process proceeds after the completion of the washing process, the garbage trapped in the garbage collecting chamber 90 can be smoothly discharged together with the washing water through a drain flow passage 74*f*. Therefore, it is not necessary to additionally clean the fine filter 92 after the washing process of the dishes has been completed.

Figure 8:
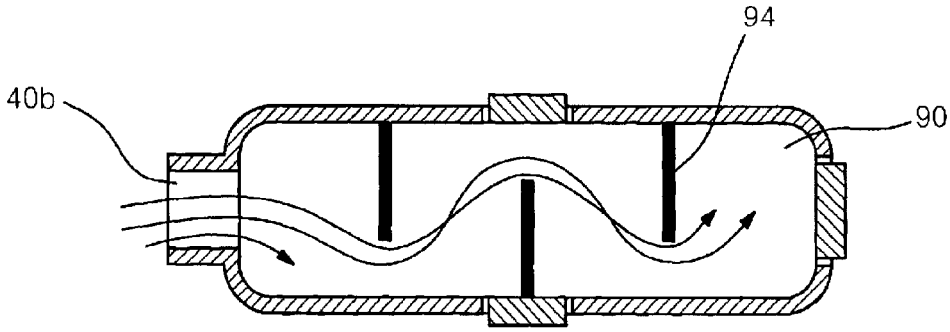
FIG. 8 is a horizontal sectional view of a garbage collecting chamber, for illustrating the operation of a dispersing means of the fine filter according to the embodiment of the present invention.
Figure 9:
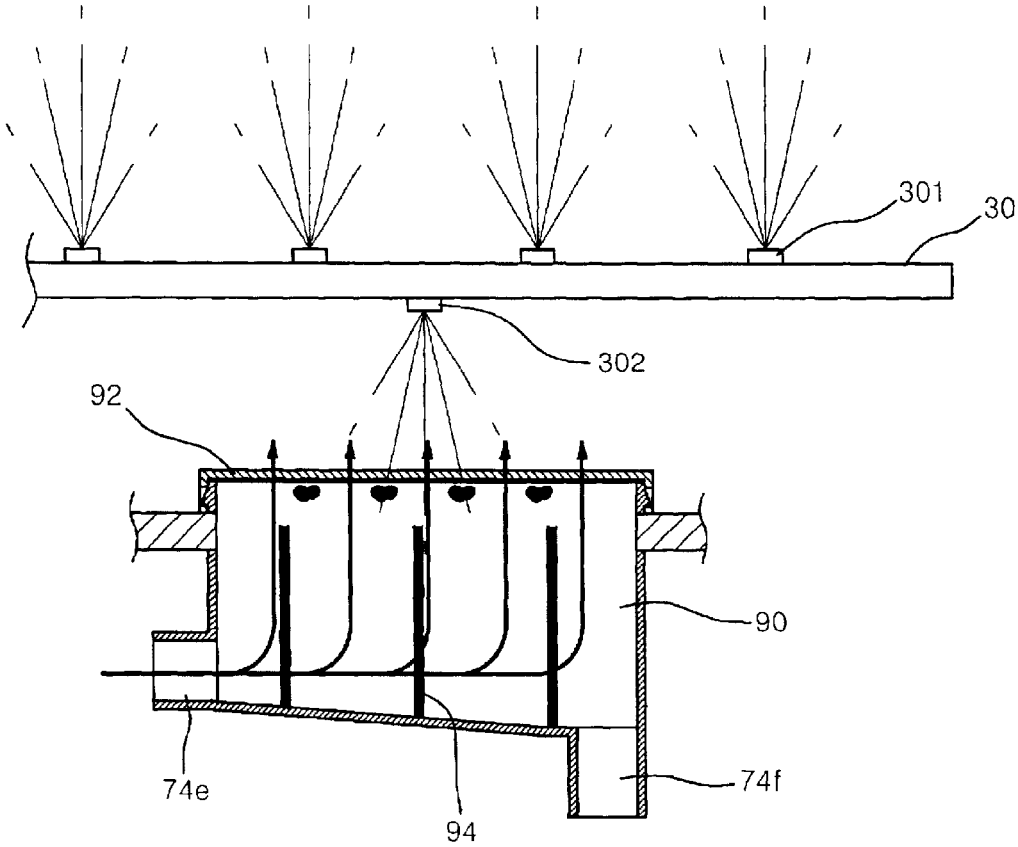
FIG. 9 is a vertical sectional view of the garbage collecting chamber, for illustrating the operation of the dispersing means of the fine filter according to the embodiment of the present invention.

According to another embodiment of the present invention, there is further provided a dispersion means for preventing the garbage from intensively building up just at the one side of the fine filter 92 (particularly, a side opposite to the inflow side) due to the flow of the washing water by dispersing the flow of the washing water introduced into the garbage collecting chamber 90. The dispersion means includes a plurality of baffles 94 alternately placed at a predetermined distance from each other within the garbage collecting chamber 90, as shown in FIG. 8.

In a case where such dispersion means is provided, since the strong flow of the washing water introduced into the garbage collecting chamber 90 by means of the pressurizing operation of the combined circulation/drain pump 70 is blocked and dispersed by a plurality of baffles 94, the washing water can be uniformly discharged throughout the entire area of the fine filter 92, thereby the garbage is more effectively filtered.

Therefore, the garbage contained in the washing water is also uniformly filtered in the entire portion of the fine filter 92, and thus, the self-cleansing function by the washing water sprayed from the auxiliary nozzle 302 can be more effectively performed.

Hereinafter, a structure of a filter self-cleansing means for further enhancing the effect of garbage filtration in an embodiment of the present invention will be explained.

Figure 10A:
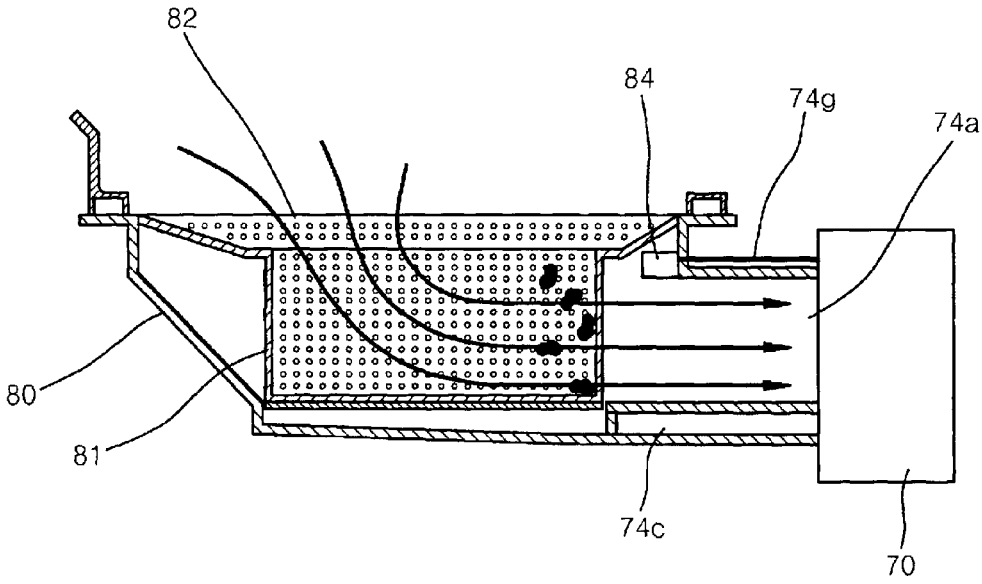
FIG. 10*a* is a view illustrating a state of a water collector and the like during the washing operation according to the embodiment of the present invention.
Figure 10B:
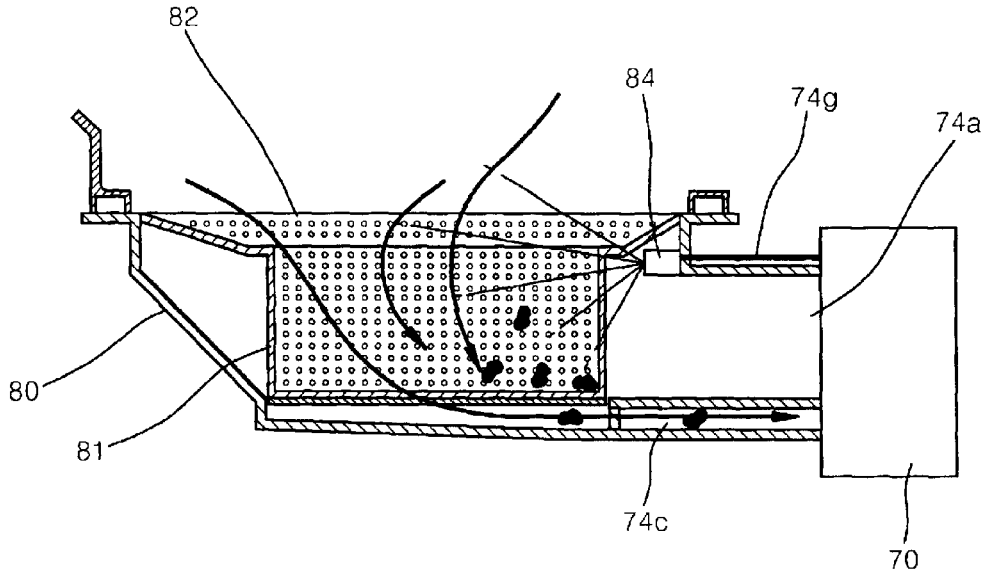
FIG. 10*b* is a view illustrating a state of the water collector and the like during the drain operation according to the embodiment of the present invention.
Figure 11A:
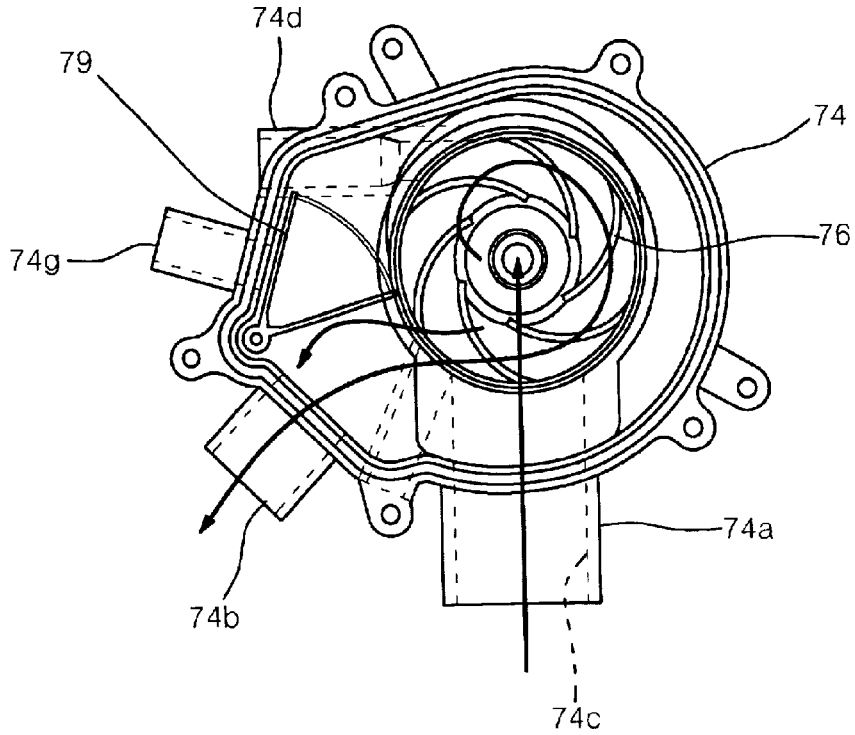
FIG. 11*a* is a view illustrating an operation of an upper pump during the washing operation according to the embodiment of the present invention.
Figure 11B:
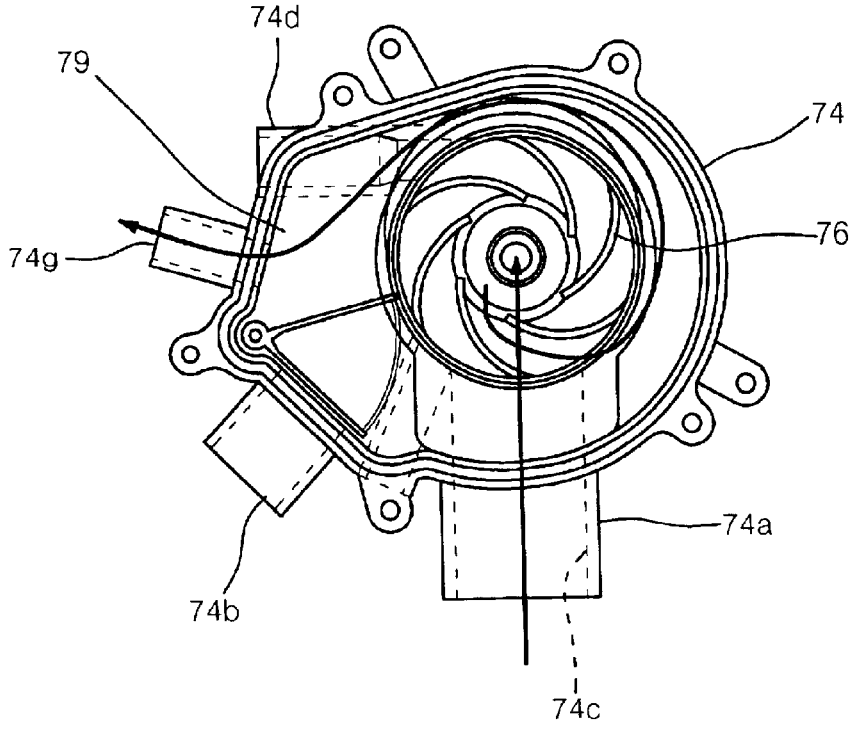
FIG. 11*b* is a view illustrating an operation of the upper pump during the drain operation according to the embodiment of the present invention.

FIG. 10*a* is a view illustrating a state of the water collector etc. during the washing process in this embodiment; FIG. 10*b* is a view illustrating a state of the water collector etc. during the drain process of this embodiment; FIG. 11*a* is a view illustrating the operation of the upper pump during the washing process of this embodiment; and FIG. 11*b* is a view illustrating the operation of the upper pump during the drain process of this embodiment.

Referring to FIGS. 10*a* to 11*b*, the dishwasher according to the embodiment of the present invention includes the filter self-cleansing means that separates foreign materials adhered to inner surfaces of the primary and secondary filter 82, 81 within the water collector 80 therefrom by spraying the washing water pressurized by the combined circulation/drain pump 70 during the drain operation.

The filter self-cleansing means includes a foreign material washing nozzle 84; an auxiliary discharge pipe 74*g* for connecting the upper pump 76 of the combined circulation/drain pump 70 to the foreign material washing nozzle 84; and a blocking barrier 79 (see FIG. 11*a*) mounted on an inlet side of the auxiliary discharge pipe 74*g*.

Here, the foreign material washing nozzle 84 is placed facing the primary and secondary filters 82, 81 such that the washing water is sprayed from the outside to the inside of the filters. The blocking barrier 79 is configured as a structure in the shape of a triangular block of which one vertex is pivotably connected to a portion adjacent the inlet of the auxiliary discharge pipe 74*g*, and is pivoted by means of the stream of water according to the rotational direction of the upper pump 76. Thus, it can open and close the inlet of the auxiliary discharge pipe 74*g*.

Particularly, in order to effectively perform the self-cleansing of the filter, it is preferred that the foreign material washing nozzle 84 is installed on a side of the washing water inlet port 74*a* in which garbage is mainly caught during the washing operation.

The operation of the dishwasher according to this embodiment constructed as such will be described below.

First, in the combined circulation/drain pump 70 during the washing operation, the upper pump 76 rotates in the clockwise direction, so that the blocking barrier 79 is pivoted on the pivotably connected vertex in the counterclockwise direction by means of the stream of water made within the upper pump 76 and blocks the inlet of the auxiliary discharge pipe 74*g*. Thus, the washing water is not sprayed through the foreign material washing nozzle 84, but it is sprayed only through the spray arm 30 (see FIG. 11*a*).

Further, garbage contained in the washing water is strained out by the primary and secondary filters 82, 81 while passing through the water collector 80. The washing water from which the garbage is removed is drawn into the combined circulation/drain pump 70 through the washing water inlet port 74*a*. At this time, the garbage in the primary and secondary filters 82, 81 is intensively collected on the side of the washing water inlet port 74*a* (see FIG. 10*a*).

On the other hand, in the drain operation, since the upper pump 76 rotates in the counterclockwise direction opposite to that of the pump 76 during the washing operation, the stream of water made within the upper pump 76 also flows in a direction opposite to that of the stream during the washing operation. The change in the stream of water causes the blocking barrier 79 to be pivoted on the vertex in the clockwise direction so that the inlet of the auxiliary discharge pipe 74*g* is opened and the washing water is supplied through the foreign material washing nozzle 84 (see FIG. 11*b*). Although pressure applied to the auxiliary discharge pipe 74*g* during the drain operation is lower than pressure applied to the pipe 74*g* by means of the upper pump 76 during the washing operation, it is sufficient to separate the foreign material adhered to the primary and secondary filters 82, 81 therefrom.

In addition, the washing water is pressurized by the upper pump 76 and supplied to the foreign material washing nozzle 84 through the auxiliary discharge pipe 74*g*. The foreign material washing nozzle 84 sprays the supplied washing water toward the primary and secondary filters 82, 81 and separates the foreign material adhered to the inner surfaces of the filters 82, 81 therefrom (see FIG. 10*b*).

Further, the foreign materials separated from the filters 82, 91 by the foreign material washing nozzle 84 are smoothly discharged together with the drained washing water through the drain discharge port 74*c*. Thus, the washing water to be fed again does not further get dirty and the circulation efficiency of the washing water to be fed again is not deteriorated.

As described above, according to the dishwasher of the present invention, there are advantages as follows.

First, since the combined circulation/drain pump for performing both the circulation and the drain of the washing water is provided, the structure of the dishwasher is simplified and production costs are lowered. Second, since the foreign materials strained out by the fine filter during the washing process are smoothly discharged during the drain process, the washing water to be fed again dose not get dirtier. Third, since the fine filter is self-cleansed, an additional cumbersome operation for removing the foreign materials after washing the dishes is not required. Fourth, since the garbage can be more effectively discharged by employing the foreign material washing nozzle, the washing water is prevented from getting dirtier and the circulation efficiency of the washing water is enhanced. Consequently, the productivity, the function, and the convenience of use thereof are improved.

What is claimed is:

1. A dishwasher, comprising:

a case;

a rack installed in the case for accommodating the dishes;

a spray arm installed below the rack for spraying washing water;

a combined circulation/drain pump including an upper pump for repeatedly pressurizing and supplying the washing water to the spray arm and a lower pump for discharging the washing water; and a filtering means for filtering the washing water, the filtering means comprising:

water collector formed below a bottom surface of the case and in a washing water flow passage connected to the combined circulation/drain pump;

a filter provided in the water collector for filtering out garbage;

a filter self-cleansing means for performing a self-cleansing operation of the filter;

a garbage collecting chamber provided below the bottom surface of the case and connected to both a washing water discharge port of the upper pump and a drain flow passage of the lower pump;

a fine filter mounted on a top surface of the garbage collecting chamber for filtering out the garbage from the washing water discharged upward; and a fine filter self-cleansing means for performing a self-cleansing operation of the fine filter.

2. The dishwasher as claimed in claim 1, wherein the fine filter self-cleansing means includes an auxiliary nozzle attached on a bottom surface of the spray arm for separating the garbage adhered to the fine filter therefrom by spraying the washing water downward.

3. The dishwasher as claimed in claim 1, wherein the garbage collecting chamber further includes a dispersing means for preventing the garbage from building up just at one side of the fine filter by dispersing a flow of the washing water introduced into the chamber by means of a pressurizing operation of the upper pump.

4. The dishwasher as claimed in claim 1, wherein the garbage collecting chamber further includes a plurality of baffles for preventing the garbage from building up just at one side of the fine filter by dispersing the washing water introduced into the chamber by means of a pressurizing operation of the upper pump.

5. The dishwasher as claimed in claim 1, wherein the combined circulation/drain pump further includes a driving motor and a pump casing connected to the driving motor, and wherein an inner space of the pump casing is divided into a circulating section connected to the washing water flow passage and a drain section connected to the drain flow passage so that the upper add lower pumps are installed in the circulating and drain sections, respectively.

6. The dishwasher as claimed in claim 1, wherein the filter self-cleansing means comprises:

a foreign material washing nozzle disposed outside the filter for spraying the washing water;

an auxiliary discharge pipe having both ends connected to the foreign material washing nozzle and the upper pump, respectively, so that the washing water can be supplied to the foreign material washing nozzle; and a blocking barrier placed in the inside of the upper pump and supported by a specific vertex which the blocking barrier pivots in the direction the upper pump rotates in order to discharge the washing water pressurized by the upper pump to the auxiliary discharge pipe during a drain operation.

7. The dishwasher as claimed in claim 6, wherein the blocking barrier has a shape of a triangular block so that it can quickly respond to a movement of a stream of water.

8. The dishwasher as claimed in claim 1, wherein the lower pump is a friction pump.

9. A dishwasher, comprising:

a case;

at least one rack instilled in the case and configured to receive a plurality of items;

a spray arm installed below the at least one rack and configured to spray washing fluid;

a comprising a first section configured to repeatedly pressurize and supply washing fluid to the spray arm, and a second section configured to discharge the washing fluid; and a filtering device configured to filter the washing fluid, comprising:

a collector formed in a washing fluid flow passage and configured to collect the washing fluid at a bottom surface of the case and to discharge the collected washing fluid to the pump;

a filter provided in the collector and configured to filter out particles; and a filter self-cleansing device configured to perform a self-cleansing operation on the filter, wherein the filter self cleansing device comprises:

a spraying portion disposed outside the filter and configured to spray washing fluid supplied by the first section of the pump onto the filter so as to dislodge particles accumulated on the filter;

a connecting portion configured to connect the spraying portion and the first section of the pump, so as to supply washing fluid to the spraying portion; and an opening/closing portion attached to the first section of the pump and configured to close during a washing operation and to open during a drain operation so as to discharge the washing fluid to the connecting portion during the drain operation.

10. The dishwasher as claimed in claim 9, wherein the filter comprises a primary filter positioned above the collector, and a secondary filter positioned below the primary filter and configured to filter out particles that were not filtered out by the primary filter.

11. The dishwasher as claimed in claim 9, further comprising a washing fluid inlet port configured to provide washing fluid from the collector to the first section of the pump during a washing operation, and a drain inlet port configured to provide washing fluid in from the collector to the second portion of the pump during a drain operation.

12. The dishwasher as claimed in claim 9, wherein the pump comprises a combined circulation/drain pump, and wherein the first section comprises a circulation section, and the second section comprises a drain section.

13. A dishwasher, comprising:

a case;

at least one rack installed in the case and configured to receive a plurality of items;

a spray arm provided below the rack and configured to spray washing fluid;

a comprising a first section configured to pressurize and supply the washing fluid to the spray arm, and a second section configured to discharge the washing fluid; and a filtering device configured to filter the washing fluid, comprising:

a collector formed in a washing fluid flow passage and configured to collect the washing fluid at a bottom surface within the case and to discharge the collected washing fluid to the pump;

a collecting chamber provided below the bottom surface of the case and connected to both a washing fluid discharge port of the first section of the pump and a drain flow passage of the second section of the pump, comprising a fine filter mounted on a top surface of the collecting chamber and configured to filter out particles from the washing fluid and a dispersing device configured to prevent particles from accumulating at one side of the fine filter by dispersing a flow of the washing fluid into the collecting chamber from the first section of the pump; and a fine filter self-cleansing device configured to perform a self-cleansing operation of on the fine filter.

14. The dishwasher as claimed in claim 13, wherein the fine filter self-cleansing device comprises an auxiliary nozzle formed on a bottom surface of the spray arm and configured to remove particles from the fine filter by spraying the washing fluid downward.

15. The dishwasher as claimed in claim 13, wherein the collecting chamber further comprises a plurality of baffles configured to prevent particles from accumulating at one side of the fine filter by dispersing a flow of washing fluid introduced into the collecting chamber through a pressurizing operation of the first section of the pump.

16. The dishwasher as claimed in claim 13, wherein the pump further comprises a driving motor and a pump casing connected to the driving motor, and wherein an inner space of the pump casing is divided into a circulating section connected to the washing fluid flow passage, and a drain section connected to the drain flow passage.

17. The dishwasher as claimed in claim 16, wherein the upper pump is installed in the circulation section of the pump, and the lower pump is installed in the drain section of the pump.

18. The dishwasher as claimed in claim 13, wherein the collector further comprises a predetermined filter structure configured to filter out particles.

19. The dishwasher as claimed in claim 13, wherein the filtering device further comprises:

a filter configured to filter out particles contained in the washing fluid; and a self-cleansing device configured to spray the washing fluid toward the filtering device so that particles filtered out by the filter can be smoothly discharged.

20. A washer, comprising:

a case;

a rack installed in the case and configured to receive a plurality of items;

a spray arm installed below the rack and configured to spray washing fluid;

a pump, including a first section configured to repeatedly pressurize and supply washing fluid to the spray arm, and a second section configured to discharge the washing fluid; and a filtering device configured to filter the washing fluid, comprising:

a fluid collector formed below a bottom surface of the case and in a flow passage connected to the pump;

a filter provided in the fluid collector and configured to filter out particles;

a filter self-cleansing device configured to perform a self-cleansing operation of the filter;

a collecting chamber provided below the bottom surface of the case and connected to both a washing fluid discharge port of the first section of the pump and a drain flow passage of the second section of the pump;

a fine filter provided at an upper surface of the collecting chamber and configured to filter out particles from the fluid as it is discharged upward; and a fine filter self-cleansing device configured to perform a self-cleansing operation of the fine filter.

21. The washer as claimed in claim 20, wherein the fine filter self-cleansing device includes an auxiliary nozzle provided on a bottom surface of the spray arm and configured to dislodge particles accumulated on the fine filter by spraying washing fluid downward.

22. The washer as claimed in claim 20, wherein the collecting chamber further comprises a dispersing device configured to prevent particles from accumulating at one side of the fine filter by dispersing washing fluid throughout the collecting chamber.

23. The washer as claimed in claim 22, wherein the flow of washing fluid is dispersed due to a pressurizing operation of the first section of the pump.

24. The washer as claimed in claim 20, wherein the collecting chamber further comprises a plurality of baffles configured to prevent particles from accumulating at one side of the fine filter by dispersing washing fluid throughout the collecting chamber.

25. The washer as claimed in claim 20, wherein the pump further comprises a pump casing connected to a driving motor, wherein an inner space of the pump casing is divided into a circulating section connected to a washing fluid flow passage, and a drain section connected to the drain flow passage.

26. The washer as claimed in claim 20, wherein the filter self-cleansing device comprises:

a foreign material washing nozzle disposed outside the filter and configured to spray washing fluid;

an auxiliary discharge pipe connected to the foreign material washing nozzle and the first section of the pump so as to supply washing fluid to the foreign material washing nozzle; and a barrier pivotably disposed within the first section of the pump, wherein the barrier is configured to pivot in the rotational direction of the first section of the pump so as to discharge washing fluid to the auxiliary discharge pipe during a drain operation.

27. The washer as claimed in claim 26, wherein the barrier comprises a substantially triangular block configured to move in response to a movement of a stream of fluid.

28. The washer as claimed in claim 20, wherein the second section of the pump comprises a friction pump.

29. The washer as claimed in claim 20, wherein the pump comprises a combined circulation/drain pump, and wherein the first section comprises a circulation section, and the second section comprises a drain section.

30. The washer as claimed in claim 20, wherein the plurality of items comprises a plurality of dishes.

31. A fluid circulation, drain and filtering system, comprising:

a combined circulation/drain pump, comprising an upper pump configured to repeatedly pressurize and supply fluid to a plurality of fluid spraying devices, and a lower pump configured to discharge the fluid; and a filtering device configured to filter the fluid, comprising:

a fluid collector provided in a flow passage formed at a lower portion of the system and configured to connect to the combined circulation/drain pump;

a filter provided in the fluid collector and configured to filter out particles;

a filter self-cleansing device configured to perform a self-cleansing operation of the filter;

a collecting chamber connected to both a fluid discharge port of the upper pump and a drain discharge flow passage of the lower pump;

a fine filter provided at an upper surface of the collecting chamber and configured to filter out particles from the fluid as it is discharged upward; and a fine filter self-cleansing device configured to perform a self-cleansing operation of the fine filter.

32. A washer comprising the fluid circulation, drain and filter system of claim 31.

* * * * *